US011433979B2

(12) United States Patent
Sullivan

(10) Patent No.: US 11,433,979 B2
(45) Date of Patent: Sep. 6, 2022

(54) REVERSIBLE CAMBER WINGS AND VEHICLES INCLUDING THE SAME

(71) Applicant: Thomas Jedidiah Sullivan, Philomath, OR (US)

(72) Inventor: Thomas Jedidiah Sullivan, Philomath, OR (US)

( * ) Notice: Subject to any disclaimer, the term of this patent is extended or adjusted under 35 U.S.C. 154(b) by 465 days.

(21) Appl. No.: 16/584,362

(22) Filed: Sep. 26, 2019

(65) Prior Publication Data

US 2021/0094663 A1 Apr. 1, 2021

(51) Int. Cl.
*B63H 9/08* (2006.01)

(52) U.S. Cl.
CPC ..... *B63H 9/08* (2013.01)

(58) Field of Classification Search
CPC ..... B63H 9/04; B63H 9/08
See application file for complete search history.

(56) References Cited

U.S. PATENT DOCUMENTS 3,332,383 A 7/1967 Wright
4,341,176 A 7/1982 Orrison
4,530,301 A * 7/1985 Latham ..... B63H 9/061 114/39.31
5,671,690 A * 9/1997 Trost ..... B63H 9/0615 114/102.23
7,114,456 B2 10/2006 Sohy
9,175,702 B1 11/2015 Bailey
9,308,979 B2 4/2016 Mostoviy
10,246,172 B2 4/2019 Arendts

* cited by examiner

*Primary Examiner* — Stephen P Avila
(74) *Attorney, Agent, or Firm* — Dascenzo Gates Intellectual Property Law, P.C.

(57) ABSTRACT

Reversible camber wings are disclosed herein. A reversible camber wing includes a first body portion that defines a trailing edge of the reversible camber wing and a second body portion that defines a leading edge of the reversible camber wing. The second body portion is configured to be selectively pivoted about a pivot axis relative to the first body portion between a first position and a second position. The reversible camber wing additionally comprises a flexible skin that extends around the first and second body portions and conforms to the body portions when the second body portion is in the first position and the second position. When the second body portion is in the first position, the reversible camber wing has a first camber, and when the second body portion is in the second position, the reversible camber wing has a second camber that is opposite the first camber.

21 Claims, 7 Drawing Sheets

REVERSIBLE CAMBER WINGS AND VEHICLES INCLUDING THE SAME

FIELD

The present disclosure relates to reversible camber wings for use as propulsion devices on marine and/or land vehicles.

BACKGROUND

Airfoils are utilized in a variety of aerodynamic and hydrodynamic applications including aircraft wings, ship and aircraft rudders, centerboards, and sails. As sails, airfoils have traditionally been constructed from a flexible cloth material, such as canvas. Because of their flexible nature, these asymmetric (cambered) sails can be inverted when a tack is performed by swinging the boom from one side of the boat to the other. However, cloth sails are less aerodynamically efficient than rigid wing-sails. Accordingly, rigid wing-sails have grown in popularity in recent years due to their ability to achieve much higher speeds when used to propel land yachts and other vehicles.

Unlike their flexible counterparts, however, rigid camber (asymmetric) wing-sails cannot invert, which means that a vehicle including such a rigid camber cannot tack, and thus can only generate lift in one direction. To enable tacking, many rigid wing-sails utilize a symmetric airfoil which can be inverted to generate lift in the opposite direction. However, these symmetric airfoils can be extremely unstable and dangerous when operating at sufficiently small angles of attack. In particular, when the angle of attack becomes too small (including when tacking) these symmetric airfoils begin to oscillate, and can do so violently enough to tear the vehicle apart and/or harm the occupants. Thus, some have proposed reversible camber wings that can invert to enable safer operation at small angles of attack (including when tacking) to avoid the dangerous consequences of symmetric wings. However, existing reversible camber wing designs are incredibly complicated, with many components and moving parts that are susceptible to fatigue. Such complicated designs are therefore less durable and more expensive than desired.

SUMMARY

Reversible camber wings are disclosed herein. Reversible camber wings comprise a first body portion, a second body portion that is configured to be selectively pivoted relative to the first body portion, and a flexible skin that extends around the first and second body portions—thereby defining an exterior surface of the reversible camber wings, in some examples. The second body portion is configured to be selectively pivoted about a pivot axis relative to the first body portion between a second-body-portion first position and a second-body-portion second position. When the second body portion is in the second-body-portion first position, the reversible camber wings have a first camber, and when the second body portion is in the second-body-portion second position, the reversible camber wings have a second camber that is opposite the first camber. The first body portion defines a trailing edge of the reversible camber wings and the second body portion defines a leading edge of the reversible camber wings. The flexible skin conforms to the first body portion and the second body portion when the second body portion is in the second-body-portion first position and when the second body portion is in the second-body-portion second position.

DESCRIPTION

Figure 1:
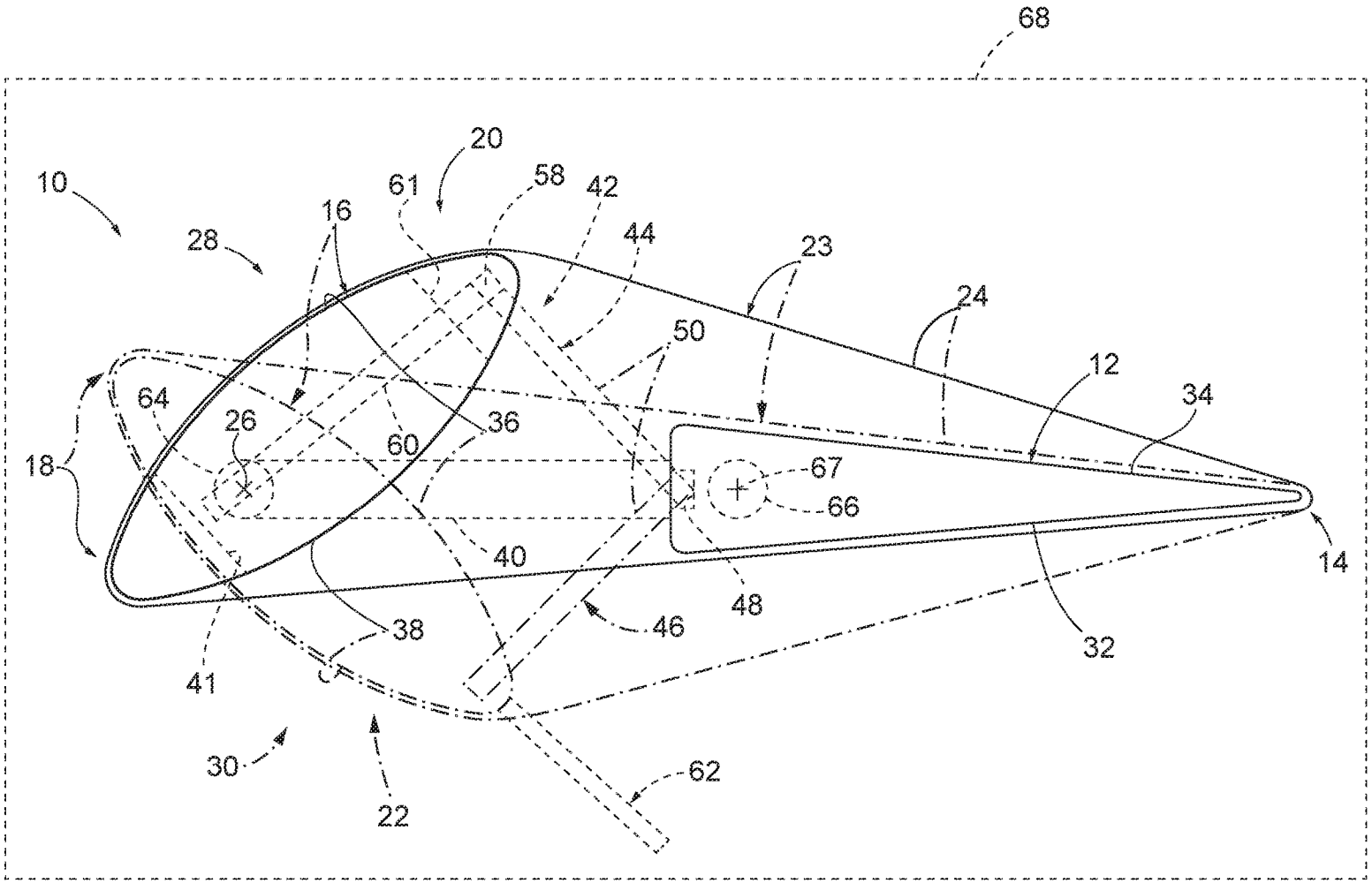
FIG. 1 is a schematic representation of reversible camber wings according to the present disclosure.

FIGS. 1-8 provide examples of reversible camber wings and vehicles, according to the present disclosure. Elements that serve a similar, or at least substantially similar, purpose are labeled with like numbers in each of FIGS. 1-8, and these elements may not be discussed in detail herein with reference to each of FIGS. 1-8. Similarly, all elements may not be labeled in each of FIGS. 1-8, but reference numerals associated therewith may be utilized herein for consistency. Elements, components, and/or features that are discussed herein with reference to one or more of FIGS. 1-8 may be included in and/or utilized with any of FIGS. 1-8 without departing from the scope of the present disclosure.

Figure 7:
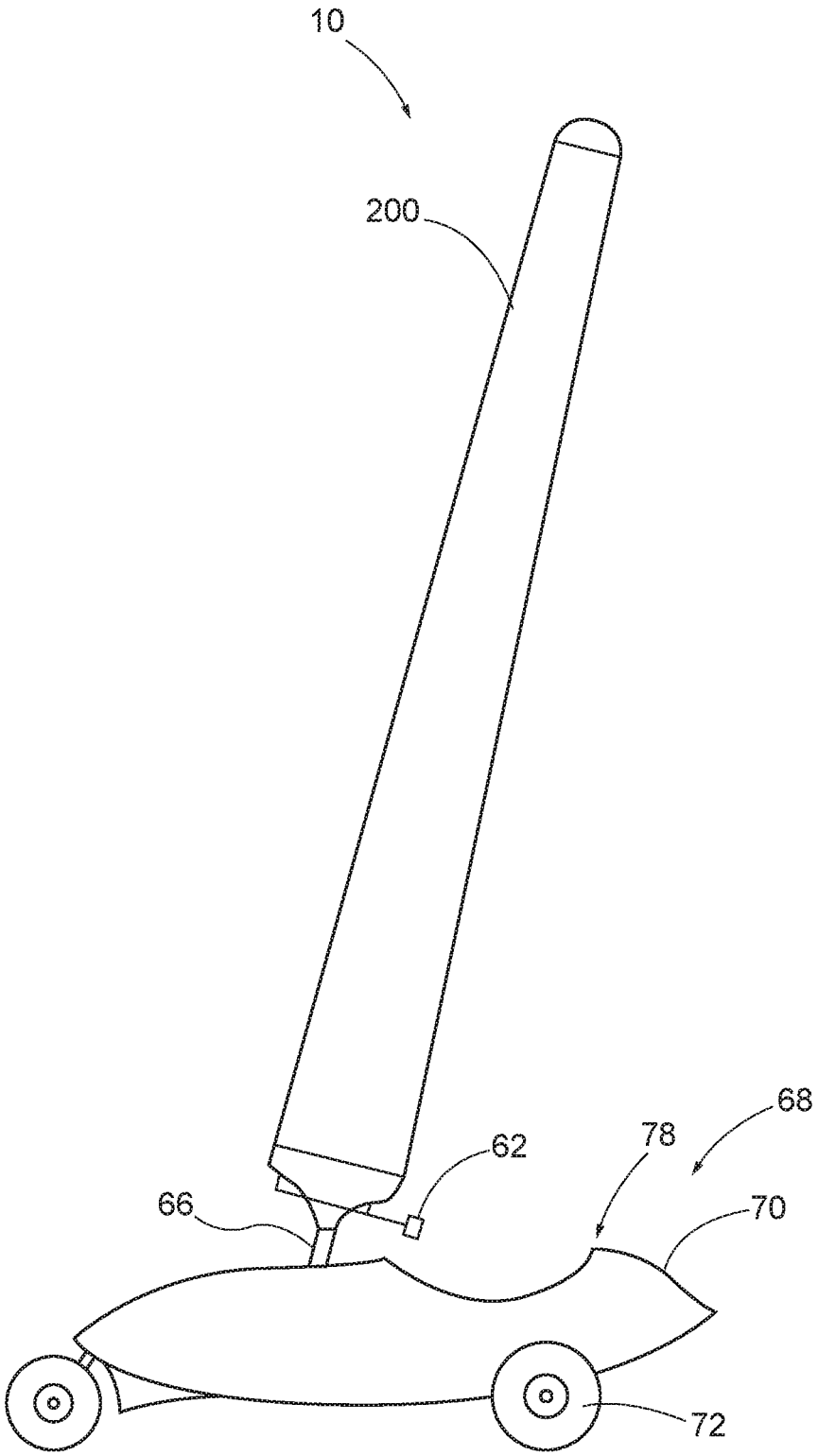
FIG. 7 is a side view of an example land vehicle that includes an example reversible camber wing according to the present disclosure.
Figure 8:
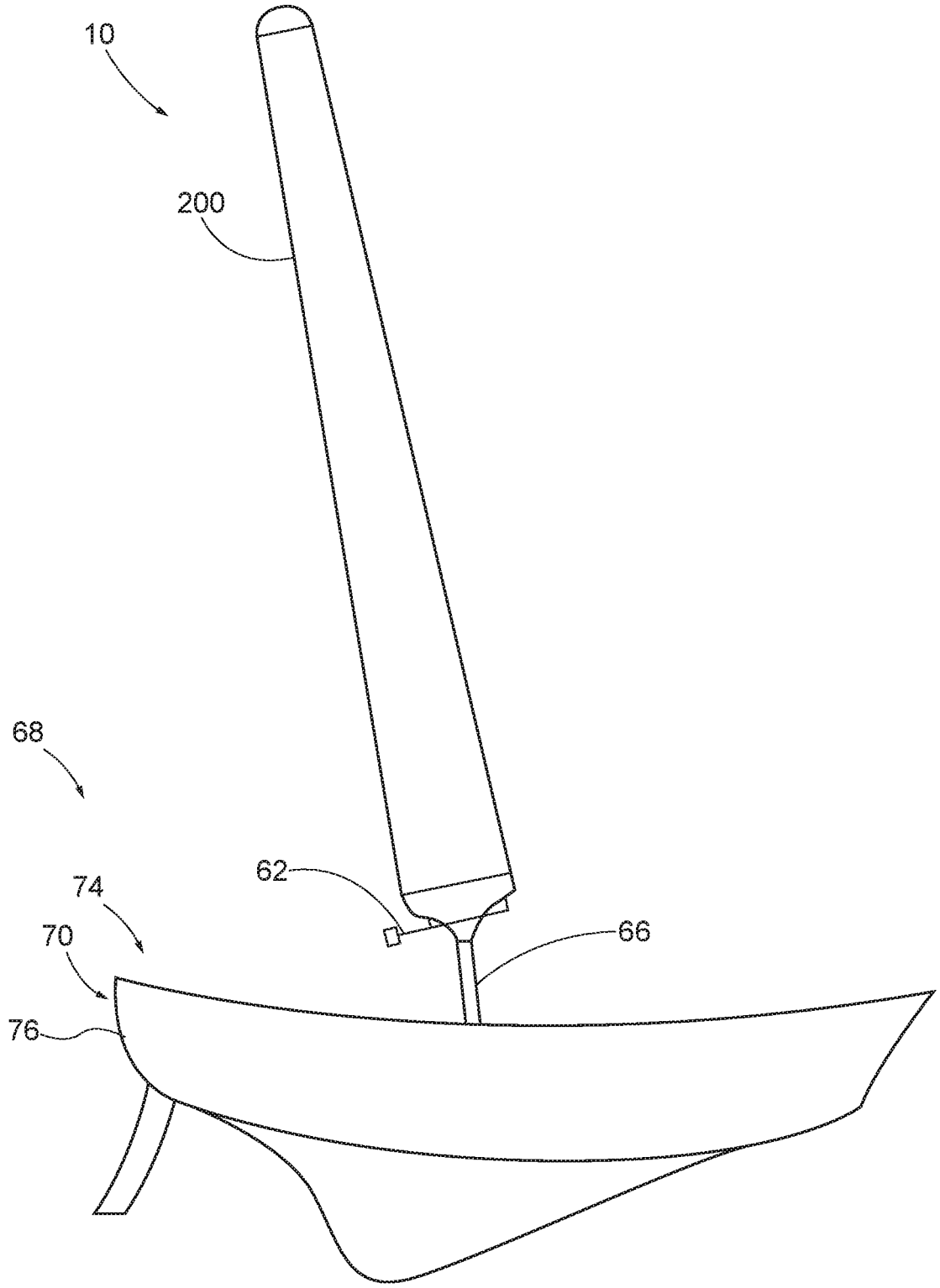
FIG. 8 is a side perspective view of an example marine vehicle that includes an example reversible camber wing according to the present disclosure.

FIG. 1 is a schematic representation of reversible camber wings 10 according to the present disclosure. In general, in FIG. 1, elements that are likely to be included in a particular embodiment are illustrated in solid lines, while elements that are optional are illustrated in dashed lines. However, elements that are shown in solid lines may not be essential and, in some embodiments, may be omitted without departing from the scope of the present disclosure. Further, in FIG. 1, select elements are shown in a different position and/or orientation using dash-dot lines. FIGS. 2-6 illustrate an illustrative, non-exclusive example of a reversible camber wing 10, designated as reversible camber wing 200 herein. FIGS. 7 and 8 illustrate illustrative, non-exclusive examples of vehicles 68 including reversible camber wing 200.

FIG. 1 shows a schematic cross-sectional representation of one of the reversible camber wings 10 in a first camber 28, and a second camber 30 that is opposite the first camber 28. The first and second cambers 28 and 30, respectively, are asymmetric airfoils that generate lift in opposite directions when air flows past the reversible camber wings 10 in a given direction. Thus, in the description herein, first camber 28 and second camber 30 also may be referred to as first asymmetric airfoil 28 and second asymmetric airfoil 30, respectively. As just one example to illustrate how a reversible camber wing 10 generates lift, if air flows from the left to the right in FIG. 1, the reversible camber wing 10 will generate lift toward the top of the page when it has the first camber 28, and will generate lift toward the bottom of the page when it has the second camber 30.

In one example, an exterior surface 23 of the reversible camber wings 10 defines the first and second cambers 28 and 30, respectively. In such examples, because the exterior surface 23 defines the exterior of the reversible camber wings 10, the exterior surface defines the shape of the airfoil of the reversible camber wings 10. In some such examples, a flexible skin 24 of the reversible camber wings 10 defines the exterior surface 23, and thus also defines the first and second cambers 28 and 30, respectively. However, in other examples, the flexible skin 24 does not extend around the entire exterior of the reversible camber wings 10, and thus only defines a portion of the exterior surface 23 and the airfoil of the reversible camber wings 10.

Figure 2:
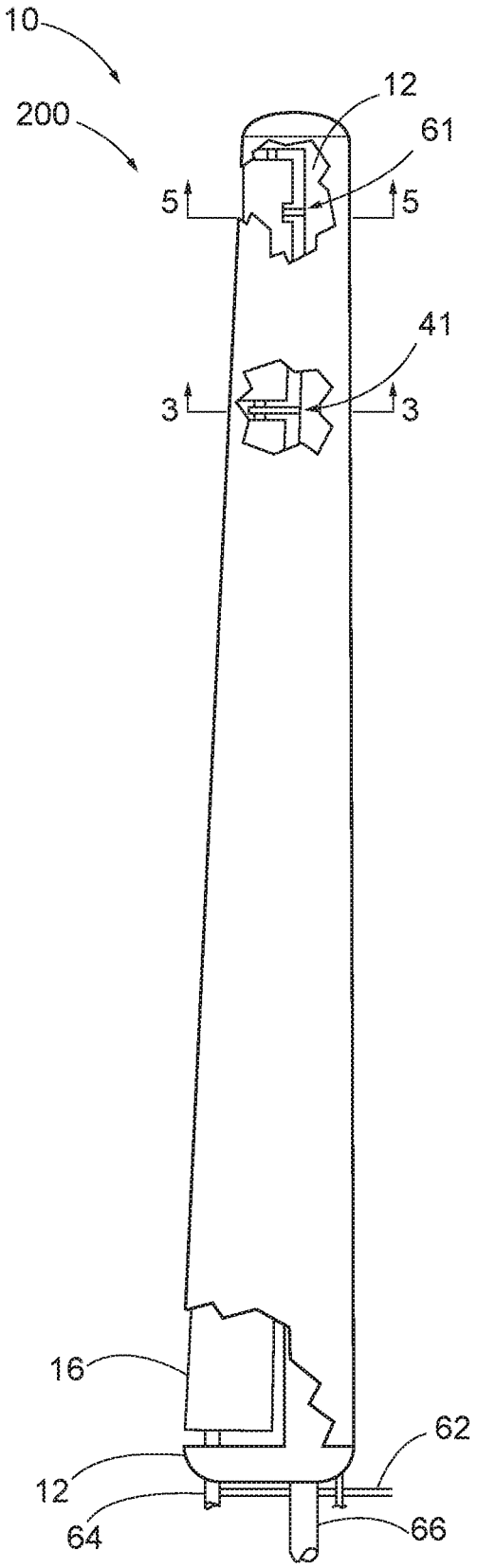
FIG. 2 is a fragmentary side view of an example reversible camber wing according to the present disclosure.
Figure 3:
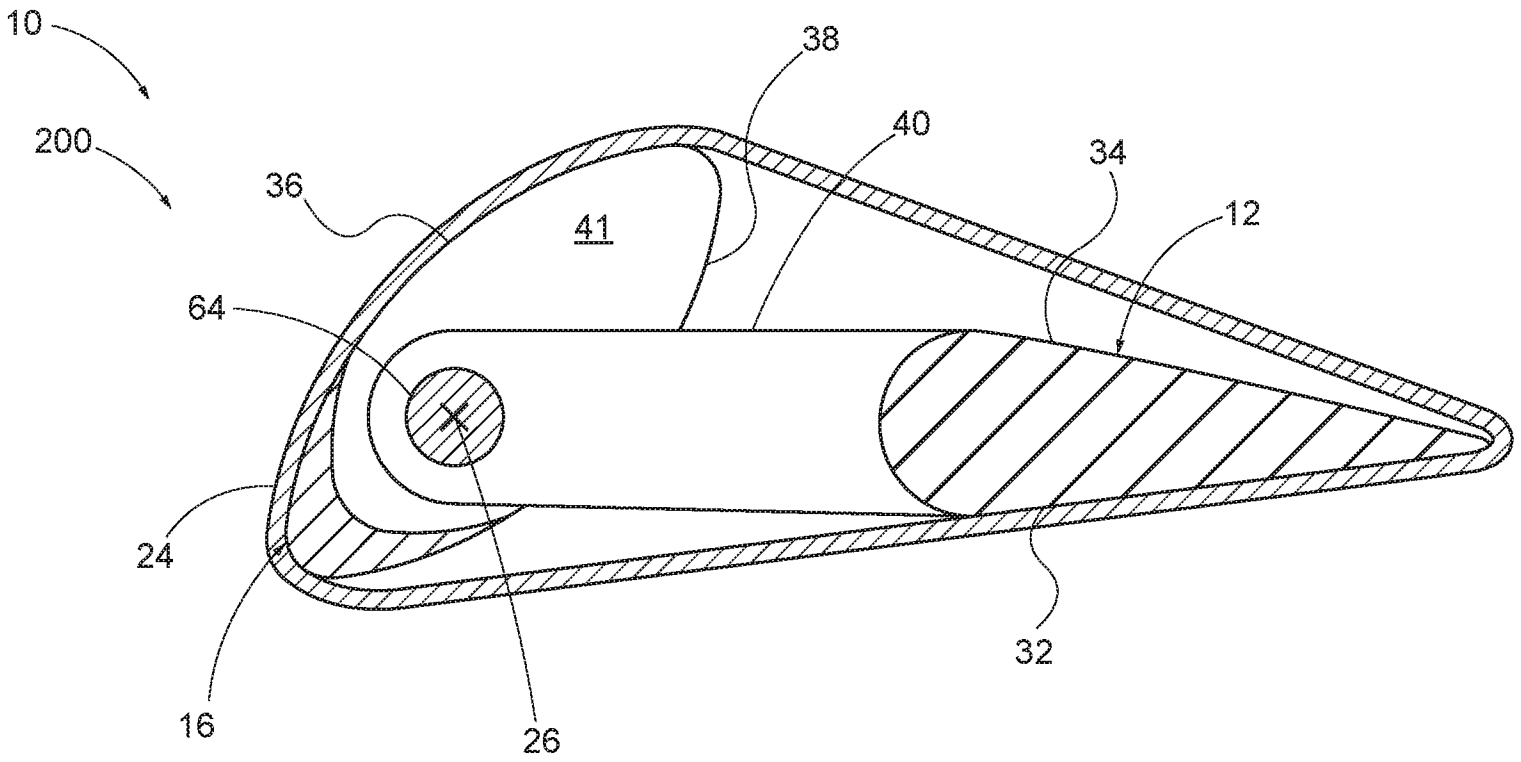
FIG. 3 is a cross-sectional view of the example reversible camber wing of FIG. 2 taken along line 3-3.
Figure 5:
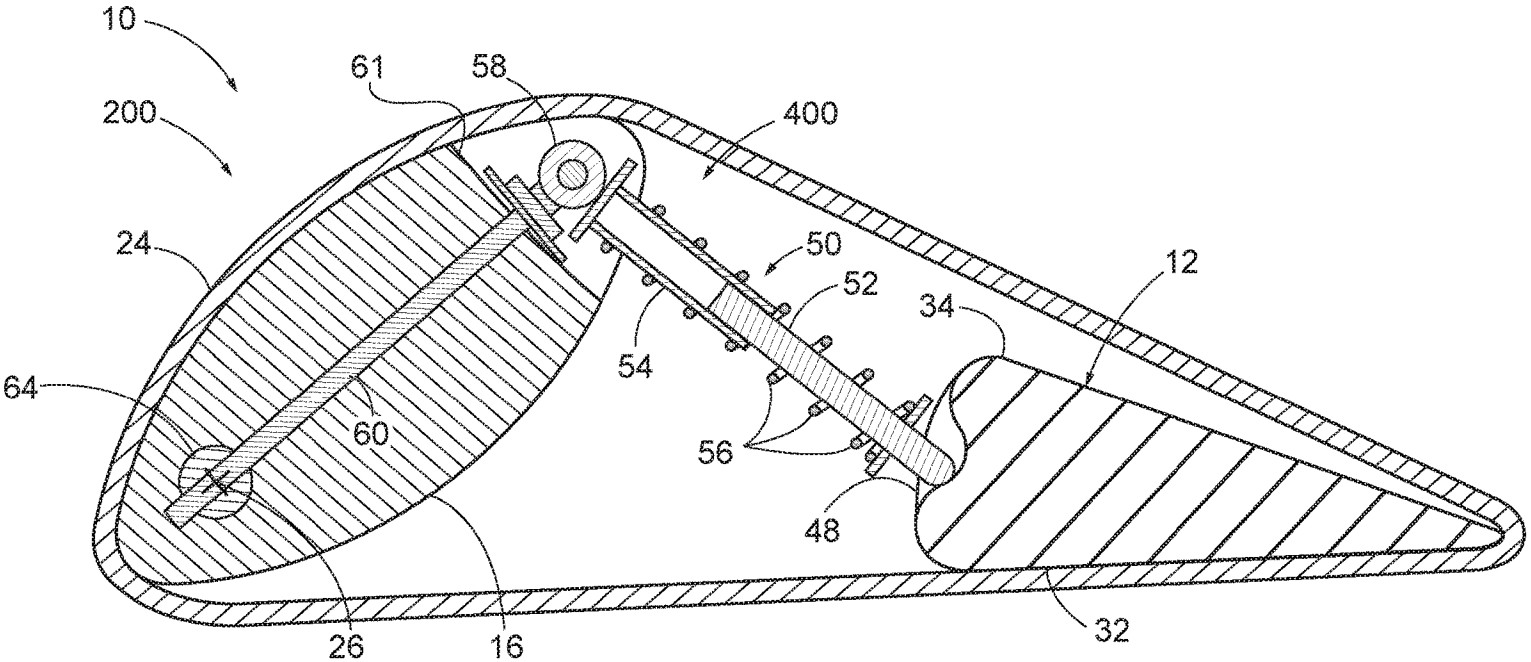
FIG. 5 is a cross-sectional view of the example reversible camber wing of FIG. 2 taken along line 5-5 in FIG. 2.

With continued reference to the schematic representation of FIG. 1, but also to the example of FIGS. 2, 3, and 5, reversible camber wings 10 comprise a first body portion 12, a second body portion 16 that is configured to be selectively pivoted relative to the first body portion 12, and a flexible skin 24 that extends around the first body portion 12 and the second body portion 16. The second body portion 16 is configured to be selectively pivoted about a pivot axis 26 relative to the first body portion 12 between a second-body-portion first position 20 and a second-body-portion second position 22. As used herein, "selective" and "selectively" when modifying an action, movement, configuration, or other activity of one or more components or characteristics of a reversible camber wing according to the present disclosure, means that the specified action, movement, configuration, or other activity is a direct or indirect result of user manipulation of an aspect of, or one or more components of, the reversible camber wing. Thus, in some examples, a user directly or indirectly pivots the second body portion 16 about the pivot axis 26 to adjust the second body portion 16 between the second-body-portion first position 20 and the second-body-portion second position 22. In some such examples, and as will be described in greater detail below, the reversible camber wings 10 include a user input mechanism 62 that is configured to selectively receive user input to selectively pivot the second body portion 16 about the pivot axis 26.

When the second body portion 16 is in the second-body-portion first position 20, the reversible camber wings 10 have the first camber 28, and when the second body portion 16 is in the second-body-portion second position 22, the reversible camber wings 10 have the second camber 30. In some examples, such as is shown in FIG. 1, the second-body-portion first position 20 and second-body-portion second position 22 are inverted positions that are mirror images of one another. Correspondingly, in such examples, the first camber 28 and second camber 30 are inverted airfoils that are mirror images of one another.

The flexible skin 24 conforms to the first body portion 12 and the second body portion 16 when the second body portion 16 is in the first position and when the second body portion 16 is in the second position. As illustrated in FIG. 1, the second body portion 16 and flexible skin 24 change positions relative to the first body portion 12 when the reversible camber wings 10 have the first camber 28 and when they have the second camber 30. For illustrative purposes, the flexible skin 24 and second body portion 16 are drawn in solid lines for the first camber 28 and dash-dot lines for the second camber 30 to show how their positioning relative the first body portion 12 changes between the two cambers 28 and 30.

The first body portion 12 defines a trailing edge 14 of the reversible camber wings 10. In one example, the trailing edge 14 is the rear of the reversible camber wings 10, relative to a direction of movement of the reversible camber wings 10. That is, when the reversible camber wings 10 are generating lift and have a non-zero speed, the trailing edge 14 may be at the back of the reversible camber wings 10 relative to the direction of motion. However, in other examples, the trailing edge 14 is not the rear of the reversible camber wings 10. For example, the trailing edge 14 may be the front of the reversible camber wings 10.

The first body portion 12 comprises a first-body-portion first surface 32 and a first-body-portion second surface 34 opposite the first-body-portion first surface 32. With the flexible skin 24, the first-body-portion first surface 32 may define a high pressure side of the reversible camber wings 10, and/or the first-body-portion first surface 32, with the flexible skin 24, may define the high pressure side of the reversible camber wings 10 depending on the position of the second body portion 16. Because the reversible camber wings 10 have a first camber 28 when the second body portion 16 is in the second-body-portion first position 20, and a second camber 30 when the second body portion 16 is in the second-body-portion second position 22, the sides of the first body portion 12 and second body portion 16 that, with the flexible skin 24, define the shorter, higher pressure side and the longer, lower pressure side of these cambers 28 and 30 are not immutable and change depending on the position of the second body portion 16.

As shown in FIG. 1, with the flexible skin 24, the first-body-portion first surface 32 defines a portion of a high pressure side (shorter side) of the reversible camber wings 10 when the second body portion 16 is in the second-body-portion first position 20 (when the reversible camber wings 10 have the first camber 28). Conversely, with the flexible skin 24, the first-body-portion second surface 34 defines a portion of a high pressure side (shorter side) of the reversible camber wings 10 when the second body portion 16 is in the second-body-portion second position 22 (when the reversible camber wings 10 have the second camber 30).

In some examples, as illustrated in FIG. 1, the first-body-portion first surface 32 and the first-body-portion second surface 34 are planar. In some such examples, such as is illustrated in FIG. 1, the first body portion 12 comprises a substantially triangular cross-sectional shape. However, in other examples, one or more of the first-body-portion first surface 32 and the first-body-portion second surface 34 are not planar and instead are curved. In one such example where both of the first-body-portion first surface 32 and the first-body-portion second surface 34 are curved, the first body portion 12 comprises a substantially circular and/or elliptical cross-sectional shape. In yet further examples, the first body portion 12 comprises a square or rectangular cross-sectional shape. In still further examples, the first body portion 12 comprises a geometric cross-sectional shape with more than four sides. In further examples, the first body portion 12 comprises an irregular cross-sectional shape.

In some examples, as illustrated in FIG. 1, the first-body-portion first surface 32 and the first-body-portion second surface 34 are continuous. In some such examples, an exterior of the first body portion 12 is smooth. However, in other examples the first-body-portion first surface 32 and the first-body-portion second surface 34 are discontinuous. In one such example, the first body portion 12 is constructed as a lattice.

In some examples, the first body portion 12 is constructed from one or more of foam, rubber, fiber-reinforced plastic, metal, and wood.

In some examples, the first body portion is not hollow. In one such example, the first body portion 12 comprises one piece of a single material, or one piece of a composite material comprising multiple materials. In another such example, where the first body portion 12 is not hollow, the first body portion 12 comprises more than one piece. As an example where the first body portion 12 comprises more than one piece, the first body portion 12 comprises a core and a skin. In some such examples where the first body portion 12 comprises a core and a skin, the core is solid. In other such examples, the core is porous and/or comprises a lattice structure. As one such example, the first body portion 12 comprises a foam core and a fiber-reinforced plastic skin. In other examples where the first body portion 12 is not hollow, the first body portion 12 comprises a porous material and/or lattice structure where an exterior of the first body portion 12 is not smooth, but rather contains one or more of cut-outs, indentations, ridges, bumps, etc.

In other examples, the first body portion 12 is hollow. In some such examples, a skin defines the first-body-portion first surface 32 and the first-body-portion second surface 34. Such a skin may comprise one or more of plastic, fiber-reinforced plastic, metal, and wood.

In some such examples, the first body portion 12 is substantially rigid. However, in other examples, the first body portion 12 is flexible. In yet further examples, the first body portion 12 is adjustable between a flexible state and a rigid state. As one such example, the first body portion 12 comprises an inflatable shell that is flexible when deflated and substantially rigid when inflated. As another such example, the first body portion 12 comprises a flexible shell that can be rigidified by use of a supportive core which may comprise one or more support members, beams, shafts, rods, etc.

The second body portion 16 comprises a second-body-portion first surface 36, and a second-body-portion second surface 38 opposite the second-body-portion first surface 36. As described above, whether the second body portion 16, with the flexible skin 24, defines the high or low pressure side of the reversible camber wings 10 changes depending on the position of the second body portion 16. As shown in FIG. 1, with the flexible skin 24, the second-body-portion first surface 36 defines a portion of a low pressure side (longer side) of the reversible camber wings 10 when the second body portion 16 is in the second-body-portion first position 20 (where the reversible camber wings 10 have the first camber 28). Conversely, with the flexible skin 24, the second-body-portion second surface 38 defines a portion of a low pressure side of the reversible camber wings 10 when the second body portion 16 is in the second-body-portion second position 22 (where the reversible camber wings 10 have the second camber 30).

In some examples, such as is shown in FIG. 1, the second-body-portion first surface 36 and the second-body-portion second surface 38 are curved and convex. In some such examples, such as is shown in FIG. 1, the second body portion 16 is symmetric about a plane that bisects the second body portion 16. In some such examples, such as is illustrated in FIG. 1, the second body portion 16 comprises an ovoid cross-sectional shape. In other such examples, the second body portion 16 comprises a circular cross-sectional shape.

However, in other examples where the second-body-portion first surface 36 and the second-body-portion second surface 38 are curved and convex, the second body portion 16 is asymmetric. That is, in such examples, the second-body-portion first surface 36 and the second-body-portion second surface 38 are not symmetric and are one or more of different lengths, different curvatures, etc.

In yet further examples where the second-body-portion first surface 36 and the second-body-portion second surface 38 are curved, one or more of the second-body-portion first surface 36 and the second-body-portion second surface 38 are concave.

In yet further examples where the second-body-portion first surface 36 and the second-body-portion second surface 38 are curved, one or more of the second-body-portion first surface 36 and the second-body-portion second surface 38 contain more than one inflection point and thus, the second body portion 16 comprises an irregular cross-sectional shape.

In some examples, the second-body-portion first surface 36 and the second-body-portion second surface 38 are not curved. In some such examples, the second body portion 16 comprises additional sides and/or the second-body-portion first surface 36 and the second-body-portion second surface 38 contain more than one inflection point. As one such example, the second-body-portion first surface 36 and the second-body-portion second surface 38 are planar, and the second body portion 16 comprises a square or rectangular cross-sectional shape. In still further examples, the second body portion 16 comprises a geometric cross-sectional shape with more than four sides.

In some examples, as illustrated in FIG. 1, the second-body-portion first surface 36 and the second-body-portion second surface 38 are continuous. In some such examples, an exterior of the second body portion 16 is smooth. However, in other examples one or more of the second-body-portion first surface 36 and the second-body-portion second surface 38 are discontinuous. In one such example, the second body portion 16 is constructed as a lattice.

In some examples, the second body portion 16 is constructed from one or more of foam, rubber, fiber-reinforced plastic, metal, and wood.

In some examples, the second body portion 16 is not hollow. In one such example, the second body portion 16 comprises one piece of a single material, or one piece of a composite material comprising multiple materials. In another such example, where the second body portion 16 is not hollow, the second body portion 16 comprises more than one piece. As an example where the second body portion 16 comprises more than one piece, the second body portion 16 comprises a core and skin. In some such examples, where the second body portion 16 comprises a core and skin, the core is solid. In other such examples, the core is porous and/or comprises a lattice structure. As one such example, the second body portion 16 comprises a foam core and a fiber-reinforced plastic skin. In other examples where the second body portion 16 is not hollow, the second body portion 16 comprises a porous material and/or lattice structure where the exterior of the second body portion 16 is not smooth, but rather contains one or more of cut-outs, indentations, ridges, bumps etc.

In other examples, the second body portion 16 is hollow. In some such examples, a skin defines the first-body-portion first surface 32 and the first-body-portion second surface 34. Such a skin may comprise one or more of plastic, fiber-reinforced plastic, metal, and wood.

In some examples, the second body portion 16 is substantially rigid. However, in other examples, the second body portion 16 is flexible. In yet further examples, the second body portion 16 can be adjusted between a flexible state and a rigid state. As one such example, the second body portion 16 may comprise an inflatable shell that is flexible when deflated and substantially rigid when inflated. As another such example, the second body portion 16 may comprise a flexible shell that can be rigidified by use of a supportive core which may comprise one or more support members, beams, shafts, rods, etc.

The second body portion 16 is pivotably coupled to the first body portion 12, in some examples. Thus, in such examples, the second body portion 16 not only is configured to pivot relative to the first body portion 12, but also is secured to the first body portion 12 such that it does not otherwise move (e.g., translate) relative to the first body portion 12. In some such examples, the second body portion 16 is pivotably coupled to the first body portion 12 via a pivot member 64 and/or at least one hinge member 40, as will be discussed in greater detail below.

In some examples, the flexible skin 24 defines the exterior surface 23 of the reversible camber wings 10. In some such examples, the flexible skin 24 forms at least a portion of the exterior of the reversible camber wings 10. In some such examples, the flexible skin 24 therefore fully extends around the first body portion 12 and second body portion 16, and completely covers the first body portion 12 and second body portion 16, such that the first body portion 12 and second body portion 16 are not visible. In some such examples, the flexible skin 24 comprises one piece. However, in other such examples, the flexible skin 24 comprises more than one piece and the different pieces may comprise different materials. As one example where the flexible skin 24 comprises more than one piece, the flexible skin 24 includes a first piece comprising a fabric material that extends around the entire first body portion 12 and second body portion 16 except for one or more of the ends of the first body portion 12 and/or second body portion 16, and includes one or more second pieces comprising one or more of plastic, rubber, metal, and wood that cover one or more of the ends of the first body portion 12 and/or second body portion 16 and act as caps for the reversible camber wings 10.

However, in other examples, the flexible skin 24 defines the exterior surface 23 of the reversible camber wings 10 at only certain sections of the reversible camber wings 10 and does not fully cover the first body portion 12 and second body portion 16. In some such examples, the flexible skin 24 does not cover ends (e.g., topmost and bottommost parts) of the first body portion 12 and second body portion 16. In some such examples, portions of the first body portion 12 and/or second body portion 16 are exposed/visible. As one such example, one or more of the ends of the first body portion 12 and/or second body portion 16 are exposed/visible. In other examples, the flexible skin 24 covers the entirety of the second body portion 16, but does not cover the entirety of the first body portion 12, such as the topmost and bottommost parts of the first body portion 12.

In some examples, the flexible skin 24 is a fabric. In some such examples, the flexible skin 24 is constructed from one or more nylon, aramid (e.g., Kevlar®), polyethylene (e.g., Tyvek®), and polyester.

With continued reference to FIG. 1, and as described above, the second body portion 16 is configured to be selectively pivoted about the pivot axis 26. Thus, the pivot axis 26 defines the axis about which the second body portion 16 is selectively pivoted relative to the first body portions 12. In some examples, including reversible camber wing 200 of FIGS. 2, 3, 5, and 6, the reversible camber wings 10 include a pivot member 64 that defines the pivot axis 26. In particular, when included, the pivot member 64 selectively pivots the second body portion 16 about the pivot axis 26 via selective user input from the user input mechanism 62. The pivot member 64 additionally or alternatively may be described as an axle, in some examples.

In some examples, such as schematically represented in FIG. 1 and including reversible camber wing 200 in FIGS. 3 and 5, the pivot axis 26 is positioned equidistant from the second-body-portion first surface 36 and second-body-portion second surface 38 (along a major, or long, axis of the cross-section of the second body portion 16). In some such examples, including in reversible camber wing 200, the pivot axis 26 is positioned on the major axis, but off of center (not aligned with a central, or longitudinal, axis of the second body portion 16). For example, as is shown in FIGS. 1, 3, and 5, the pivot axis 26 is positioned more proximate the leading edge 18 than the center of the major axis of the cross-section of the second body portion 16. By positioning the pivot axis 26 more proximate the leading edge 18 than the central axis, the leading edge 18 is substantially aligned with the first-body-portion first surface 32 when the second body portion 16 is in the second-body-portion first position 20, such that the high pressure side of the reversible camber wings 10 is substantially planar when the reversible camber wings 10 have the first camber 28, as shown in FIG. 1. Further, when the second body portion 16 is in the second-body-portion second position 22, the leading edge 18 is substantially aligned with the first-body-portion second surface 34 such that the high pressure side of the reversible camber wings 10 is substantially planar when the reversible camber wings 10 have the second camber 30.

However, in other examples, the pivot axis 26 is positioned at the central axis of the second body portion 16. In further examples, the pivot axis 26 is positioned on the major axis, but more distant from the leading edge 18 than the central axis of the second body portion. In still further examples, the pivot axis 26 is positioned off the major axis, closer to one of the second-body-portion first surface 36 and second-body-portion second surface 38 than the other.

In some examples, when the second body portion 16 is in the second-body-portion first position 20 and the second-body-portion second position 22, the flexible skin 24 is taut (generating the substantially planar high pressure side of the reversible camber wings 10) and exerts a compressive force on the second body portion 16 and/or first body portion 12. Thus, as will be described in greater detail below, in some examples, the reversible camber wings 10 include at least one bias mechanism 42, to oppose the compressive force exerted by the flexible skin 24, and hold the second body portion 16 in the second-body-portion first position 20 and second-body-portion second position 22.

In some examples, the flexible skin 24 is fixedly secured to one or more of the first body portion 12 and second body portion 16. In some such examples, the first body portion 12 is fixedly secured to the first body portion 12 at the trailing edge 14 and/or to the second body portion 16 at the leading edge 18. In some such examples, the flexible skin 24 is fixedly secured to the first body portion 12 at the trailing edge 14 and/or to the second body portion 16 at the leading edge 18 via an adhesive and/or a fastener. Some such adhesives include tape, glue, epoxies and/or other polymers, and plastics.

In other examples, the flexible skin 24 is not fixedly secured to one or more of the first body portion 12 and second body portion 16. In some such examples, the flexible skin 24 is fixedly secured to another component of the reversible camber wings 10.

In yet further examples, the flexible skin 24 is held in place around the first body portion 12 and/or the second body portion 16 merely by tension alone and is not fixedly secured to the first body portion 12 or second body portion 16 via any adhesives or fasteners.

In some examples, the flexible skin 24 is only taut when the second body portion 16 is in the second-body-portion first position 20 and when the second-body-portion second position 22 (i.e. when the reversible camber wings 10 have cambers 28 and 30, respectively). In some such examples, the flexible skin 24 is loose when the second body portion 16 is in a position between the second-body-portion first position 20 and the second-body-portion second position 22. In some such examples where the flexible skin 24 is loose, the flexible skin 24 is held in place via the coupling to the first body portion 12 and/or the second body portion 16. In some such examples, the flexible skin 24 moves around the leading edge 18 as the second body portion 16 pivots between the second-body-portion first position 20 and the second-body-portion second position 22. For example, when the flexible skin 24 is coupled to the trailing edge 14, the flexible skin 24 moves around the leading edge 18 as the second body portion 16 pivots between the second-body-portion first position 20 and the second-body-portion second position 22. In other examples, where the flexible skin 24 is coupled to the leading edge 18, the flexible skin 24 moves around the trailing edge 14 as the second body portion 16 pivots between the second-body-portion first position 20 and the second-body-portion second position 22.

However, in other examples, the flexible skin 24 is taut even when the second body portion 16 is not in the second-body-portion first position 20 and the second-body-portion second position 22 (e.g., is in a position between the second-body-portion first position 20 and the second-body-portion second position 22). Thus, in some such examples, the reversible camber wings 10 may be variable and configured to be selectively adjusted to one or more positions between the second-body-portion first position 20 and the second-body-portion second position 22, such that the reversible camber wings 10 have more cambers than just the first camber 28 and the second camber 30, including intermediary cambers between the first camber 28 and the second camber 30.

In some such examples, the flexible skin 24 comprises a stretchable material that passively maintains tension in the flexible skin 24 when the second body portion 16 is not in the second-body-portion first position 20 and the second-body-portion second position 22.

In other such examples, the reversible camber wings 10 include a tensioning mechanism that actively maintains the tension in the flexible skin 24 when the second body portion 16 is not in one of the second-body-portion first position 20 and the second-body-portion second position 22. As one such example of an active tensioning mechanism, the reversible camber wings 10 include a ratchet that effectively changes the length of the flexible skin 24, and maintains tension in the flexible skin 24, when the second body portion 16 is in a position between the second-body-portion first position 20 and the second-body-portion second position 22. In particular, the ratchet shortens the flexible skin 24 as the second body portion 16 pivots away towards an intermediate position between the second-body-portion first position 20 and the second-body-portion second position 22 where the second body portion 16 is aligned with the first body portion 12, and lengthens the flexible skin 24 as the second body portion 16 moves away from the intermediate position towards the second-body-portion first position 20 and/or the second-body-portion second position 22. As an illustrative, non-exclusive example, an active tensioning mechanism may be positioned within one of the first body portion 12 and the second body portion 16, with the flexible skin 24 extending into the first body portion 12 or the second body portion 16 and operatively coupled to the active tensioning mechanism therein.

As yet another example, a tensioning mechanism may be included between the first body portion 12 and the flexible skin 24 that pushes on the flexible skin 24 to keep it taut while the second body portion 16 moves between the second-body-portion first position 20 and the second-body-portion second position 22. In particular, the tensioning system may increase in length when the second body portion 16 moves away from the second-body-portion first position 20 and/or second-body-portion second position 22 towards an intermediate position to push the flexible skin 24 further away from the first body portion 12 and maintain tension in the flexible skin 24. As one such example, the tensioning mechanism may comprise a passive system such as a strut assembly that relies on one or more of a spring and hydraulic pressure to maintain tension in the flexible skin 24. In other such examples, the tensioning mechanism may comprise an active system.

As used herein, "taut" refers to a state of the flexible skin 24 where the flexible skin 24 is substantially free of wrinkles and is under enough tension to be substantially rigid and exert a compressive force on the first body portion 12 and/or the second body portion 16.

By including a pivotable second body portion, the reversible camber wings 10 of the present disclosure provide several technical effects. First, the second body portion 16 enables the reversible camber wings 10 to be reversible, that is to generate lift in opposite directions, thereby permitting tacking and heading changes. Second, the second body portion 16 is a simpler design than conventional reversible wings, which makes manufacturing easier, reduces production costs, and increases the longevity and durability of the reversible camber wings 10.

Further, because the stress forces experienced by an asymmetric (cambered) wing during a tack are much less than a symmetric wing, the reversible camber wings of the present disclosure are safer and less susceptible to fatigue and degradation during a tack than symmetric wings.

Figure 4:
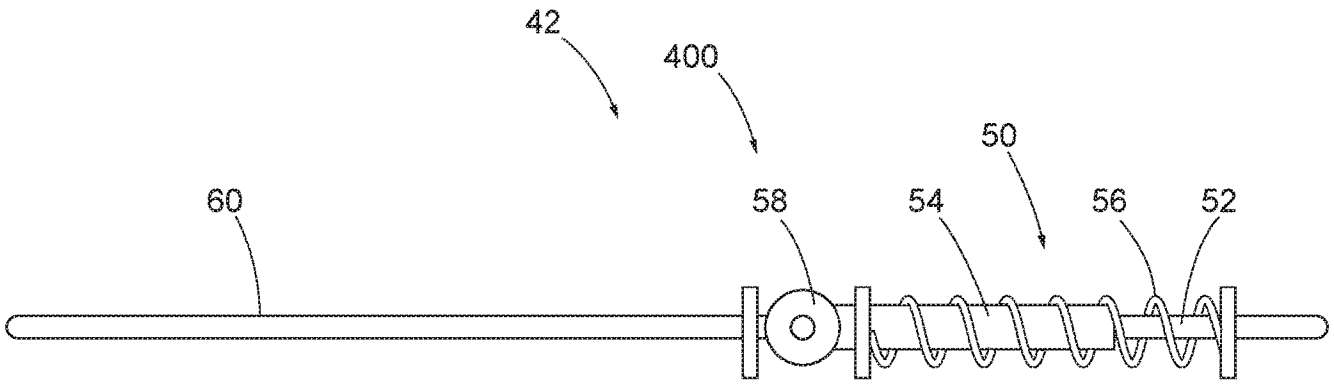
FIG. 4 is a top view of an example bias mechanism of the example reversible camber wing of FIG. 2.

With continued reference to the schematic representation of FIG. 1, and as briefly mentioned above, in some examples, including reversible camber wing 200, as shown in FIGS. 4 and 5, the reversible camber wings 10 further comprise at least one bias mechanism 42. Reversible camber wing 200 includes a plurality of bias mechanisms 42, and any suitable number of bias mechanisms 42 may be provided depending on the length, configuration, construction, use, and/or other factors associated with a reversible camber wing 10.

The bias mechanism(s) 42 is configured to oppose the compressive force exerted by the flexible skin 24 on the second body portion 16 and to bias the second body portion 16 toward the second-body-portion first position 20 when the second body portion 16 is selectively pivoted toward the second-body-portion first position 20, and to bias the second body portion 16 toward the second-body portion second position 22 when the second body portion 16 is selectively pivoted toward the second-body-portion second position 22. In this way, the bias mechanism 42 effectively holds and/or locks the second body portion 16 in the second-body-portion first position 20 and the second-body-portion second position 22, in some examples. In some such examples, the bias mechanism 42 is configured to supply a force on the second body portion 16 and flexible skin 24 sufficient to resist the compressive force of the flexible skin 24, and hold the second body portion 16 in the second-body-portion first position 20 and the second-body-portion second position 22 (e.g., the force exerted on the second body portion 16 by the bias mechanism 42 or bias mechanisms 42 effectively equals the opposite compressive force exerted on the second body portion 16 by the flexible skin 24). However, in some such examples, the force exerted by the bias mechanism(s) can be overcome by additional external forces. As one example, increases in wind speed relative to the reversible camber wings 10 and/or changes in wind direction relative to the reversible camber wings 10 may be sufficient to overcome the force supplied by the bias mechanism(s) 42 and to push the second body portion 16 towards an intermediate position between the second-body-portion first position 20 and the second-body portion second position 22. As another example, a user selectively applies a force to the second body portion 16 that overcomes the force supplied by the bias mechanism(s), and thereby pushes the second body portion 16 towards an intermediate position between the second-body-portion first position 20 and the second-body-portion second position 22, by selectively manipulating the user input mechanism 62. Specifically, the user input mechanism 62 is configured to apply a torsional force to second body portion 16 upon user actuation of the user input mechanism 62, which if sufficient to overcome the force exerted by the bias mechanism(s) 42, causes the second body portion 16 to pivot about the pivot axis 26.

In other examples, the bias mechanism(s) 42 supplies a force to the second body portion 16 that is not sufficient to hold the second body portion 16 in the second-body-portion first position 20 and/or the second-body-portion second position 22. In some such examples, a user must provide an additional force (such as by selectively operating the user input mechanism 62) to hold the second body portion 16 in one or more of the second-body-portion first position 20 and the second-body-portion second position 22.

As will be described in greater detail below, the bias mechanism(s) 42 may include various mechanisms for providing the force to the second body portion 16 that opposes the compressive force of the flexible skin 24. As just one example, the bias mechanism(s) 42 includes a strut assembly including a spring that biases the second body portion 16 towards the second-body-portion first position 20 and/or the second-body-portion second position 22. However, in other examples, the bias mechanism(s) 42 includes another type of passive biasing mechanism (e.g., a hydraulic strut) and/or an active biasing mechanism such as one or more electronically controlled actuators (e.g., electromagnetic, pneumatic, hydraulic, etc.).

When included, the bias mechanism(s) 42 is operatively coupled between the first body portion 12 and the second body portion 16. In some examples, such as is shown in FIG. 1, the bias mechanism(s) 42 is configured to pivot relative to the first body portion 12 between a bias-mechanism first position 44 when the second body portion 16 is in the second-body-portion first position 20 and a bias-mechanism second position 46 when the second body portion 16 is in the second-body-portion second position 22. As shown in FIG. 1, the bias-mechanism first position 44 and bias-mechanism second position 46 are inverted positions that are mirror images of one another.

In some examples, the bias mechanism(s) 42 is coupled to the first body portion 12. In particular, in some such examples, including reversible camber wing 200, as shown in FIGS. 1 and 5, the first body portion 12 comprises at least one pocket 48, into which a bias mechanism 42 extends, and which is configured to permit the bias mechanism 42 to pivot between the bias-mechanism first position 44 and the bias-mechanism second position 46. In some such examples, the bias mechanism 42 is coupled to a respective pocket 48 and selectively pivots relative to the first body portion 12 in the pocket 48.

However, in other such examples, the first body portion 12 comprises a pivotable coupling mechanism other than a pocket that couples the respective bias mechanism 42 to the first body portion 12 and holds the bias mechanism 42 in place while permitting the bias mechanism 42 to pivot relative to the first body portion 12. As one such example, the first body portion 12 comprises a pin that extends through an end of a bias mechanism 42. In such an example, the pin holds the bias mechanism 42 in place while permitting the bias mechanism 42 to pivot about the pin.

When included, the bias mechanism(s) 42 is additionally or alternatively coupled to the second body portion 16, in some examples. In some such examples, and as shown in FIGS. 1 and 4-5, a bias mechanism 42 comprises a hinge 58 and a support member 60, with the support member 60 being operatively supported by the second body portion 16, and with the hinge 58 permitting the bias mechanism 42 to transition between the bias-mechanism first position 44 and the bias-mechanism second position 46 when the second body portion 16 transitions between the second-body-portion first position 20 and the second-body-portion second position 22.

As schematically represented in FIG. 1 and shown in the example of FIGS. 2 and 5, when the hinge 58 is included, the second body portion 16 in some such examples comprises at least one recess 61, within which the hinge 58 of a respective bias mechanism 42 is positioned. In some such examples, including reversible camber wing 200, the recess 61 is included at an outer, peripheral edge/surface of the second body portion 16, as best seen in FIGS. 2 and 5.

When a recess 61 is included, the hinge 58 is coupled to the at least one recess 61 in some examples (e.g., such as when support member 60 is not included). As one example, the recess 61 comprises a pocket that receives the hinge 58, holds the hinge 58 in place relative to the second body portion 16, and permits the hinge 58 to pivot relative to the second body portion 16, similar to how pocket 48 of first body portion 12 holds the at least one bias mechanism 42 in place relative to the first body portion 12 and permits the at least one bias mechanism 42 to pivot relative to the first body portion 12.

However, in other examples where the hinge 58 is coupled to the second body portion 16, the hinge 58 is coupled to the second body portion 16 via a different pivotable coupling mechanism (e.g., not a pocket). As just one example, the second body portion 16 and/or a recess 61 comprises a pin that extends through the hinge 58 and/or an end of the corresponding bias mechanism 42 that holds the bias mechanism 42 in place relative to the second body portion 16, while permitting the bias mechanism 42 to pivot relative to the second body portion 16.

When included, the support member 60 extends from the hinge 58 and into the second body portion 16 to a position within the second body portion 16 more proximate the pivot axis 26 than the hinge 58. As just one such example, and as shown in FIGS. 1 and 5, the hinge 58 is positioned within a recess 61, the recess 61 is located at an outer, peripheral edge/surface of the second body portion 16, and the support member 60 extends from the recess 61 further into the interior of the second body portion 16. In some such examples, the support member 60 is coupled to the second body portion 16 at the pivot axis 26.

While the at least one bias mechanism 42 is shown schematically in FIG. 1, the example bias mechanism 42 of reversible camber wing 200 is shown in FIGS. 4 and 5 and is designated herein as bias mechanism 400. Bias mechanism 400 comprises a strut assembly 50. In some examples, the strut assembly 50 extends from the hinge 58, between the first body portion 12 and the second body portion 16. In particular, in some such examples, the strut assembly 50 couples to the first body portion 12 at a pocket 48. When the support member 60 is included, as in example bias mechanism 400, the strut assembly 50 extends from the hinge 58 opposite the support member 60. In this way, support member 60 and strut assembly 50 selectively pivot relative to one another about the hinge 58 when the second body portion 16 pivots between the second-body-portion first position 20 and the second-body-portion second position 22.

Strut assembly 50 comprises a piston 52, a piston-receiving chamber 54, and a spring 56. The spring 56 provides the force to the second body portion 16 that opposes the compressive force from the flexible skin 24. In particular, the spring 56 biases the piston 52 away from the piston-receiving chamber 54 when the spring 56 is compressed. Thus, when included in the reversible camber wings 10, by biasing the piston 52 away from the piston-receiving chamber 54, the spring 56 biases the second body portion 16 toward the second-body-portion first position 20 when the second body portion 16 is selectively pivoted toward the second-body-portion first position 20 and biases the second body portion 16 toward the second-body-portion second position 22 when the second body portion 16 is selectively pivoted toward the second-body-portion second position 22. In particular, the spring 56 pushes the second body portion 16 against the flexible skin 24 by pushing the piston 52 out of the piston-receiving chamber 54.

However, in other examples, the reversible camber wings 10 comprise a different type of bias mechanism than the strut assembly 50. As one such example, the reversible camber wings 10 comprise a different type of passive bias mechanism. As one example of a passive bias mechanism, the passive bias mechanism includes a hydraulic strut assembly similar to strut assembly 50, in which instead of the spring 56, the hydraulic strut includes a closed piston-receiving chamber that contains a hydraulic fluid. The hydraulic fluid biases the piston away from the piston-receiving chamber when the pressure within the chamber is greater than the pressure outside the chamber (e.g., atmospheric pressure).

In other examples where the reversible camber wings 10 comprise a different type of bias mechanism than the strut assembly 50, the reversible camber wings 10 comprise an active (not passive) bias mechanism. As one example, the reversible camber wings 10 comprise electronically controlled actuators such as one or more of electromagnetic, pneumatic, and hydraulic. In such examples, the reversible camber wings 10 may additionally include a controller comprising non-transitory memory with stored computer readable instructions for adjusting the various actively controlled actuators. When included, the controller includes a processor for executing the computer readable instructions.

In yet further examples, a bias mechanism 42 comprises a passive bias mechanism (e.g., strut assembly 50) and the user input mechanism 62 comprises an electronically controlled actuator. For example, rather than comprising a mechanically-actuated device, such as a lever, where the user supplies the force necessary to pivot the second body portion 16, the user input mechanism 62 in some examples comprises an electronically-controlled actuator that adjusts the position of the second body portion 16 responsive to user input via an input device, such as one or more of a steering wheel, joystick, keypad, touchscreen, buttons, etc. In such examples, the electronically controlled actuator moves the second body portion 16 between the second-body-portion first position 20 and the second-body-portion second position 22, while the bias mechanism(s) 42 permits the second body portion 16 to wobble at the second-body-portion first position 20 and the second-body-portion second position 22 responsive to changes in forces acting on the reversible camber wings 10 (e.g., changes in wind speed and/or direction), thereby dampening stress on the reversible camber wings 10.

By providing bias mechanism(s) 42, multiple technical effects are achieved. First, the bias mechanism(s) 42 dampens external forces (e.g., mechanical/physical shock) exerting stress (e.g., shear stress) on the reversible camber wings 10 by absorbing at least some of these forces and permitting the second body portion 16 to wobble/give. The reversible camber wings 10 are therefore less likely to be damaged and/or to dislodge from a vehicle to which they are coupled. As such, the reversible camber wings 10 are safer and more durable than rigid symmetric wing designs.

Further, the bias mechanism(s) 42 is simpler and contains fewer components than conventional reversible wing designs, resulting in a cheaper and simpler design. Further, because the bias mechanism(s) incorporates fewer moving parts, the reversible camber wings 10 of the present disclosure are more durable and less likely to fail than conventional reversible wing designs.

In some examples, including reversible camber wing 200, and as shown in FIGS. 1 and 3, the reversible camber wings 10 additionally include at least one hinge member 40. Reversible camber wing 200 includes a plurality of hinge members 40, and any suitable number of hinge members 40 may be provided depending on the length, configuration, construction, use, and/or other factors associated a reversible camber wing 10. When included, a hinge member 40 comprises a pivotable coupling mechanism (e.g., hinge, pivotable joint, etc.) that supports the second body portion 16 (i.e. couples the second body portion 16 to the first body portion 12) while permitting the second body portion 16 to pivot relative to the first body portion 12. In some examples when a reversible camber wing 10 includes a hinge member 40, the second body portion 16 comprises a corresponding channel 41, within which the hinge member 40 is positioned.

As shown in FIGS. 1 and 3, the hinge member 40 extends from the first body portion 12 and supports the second body portion 16. In some examples, the hinge member 40 is included in the first body portion 12. In other examples, the hinge member 40 is a separate component that is coupled to the first body portion 12.

Further, the hinge member(s) 40 is coupled to the second body portion 16 to support the second body portion 16, while permitting the second body portion 16 to pivot relative to the first body portion 12. In some examples, such as is shown in FIG. 3, the channel 41 extends to and/or past the pivot axis 26, and the at least one hinge member 40 extends into the at least one channel 41 and is coupled to the second body portion 16 at the pivot axis 26. Thus, in such examples, the at least one hinge member 40 defines the pivot axis 26. In some such examples, the hinge member 40 is coupled to the pivot member 64. In one such example where the pivot member 64 does not extend through the second body portion 16, a pin or other axle is included in the at least one channel 41, and the hinge member 40 pivots about that pin/axle. However, in other such examples the pivot member 64 extends through the second body portion 16 along the pivot axis 26, and thus the hinge member 40 couples to the pivot member 64.

Although the channel 41 is shown as extending past the pivot axis 26 in FIG. 3, the channel 41 in other examples is not as deep (i.e. does not extend all the way to the pivot axis 26). In some such examples, the hinge member 40 is coupled to the second body portion 16 at a position more distant from the leading edge 18 than that shown in FIGS. 1 and 3 (e.g., the central axis of the second body portion 16).

In still further examples, the channel 41 is not included at all, and the at least one hinge member 40 is coupled to an outer edge of the second body portion 16.

When included, the channel 41 in some examples extends from the second-body-portion first surface 36 to the second-body-portion second surface 38, as shown in FIGS. 2 and 3, to permit the hinge member to pivot relative to the second body portion 16.

Figure 6:
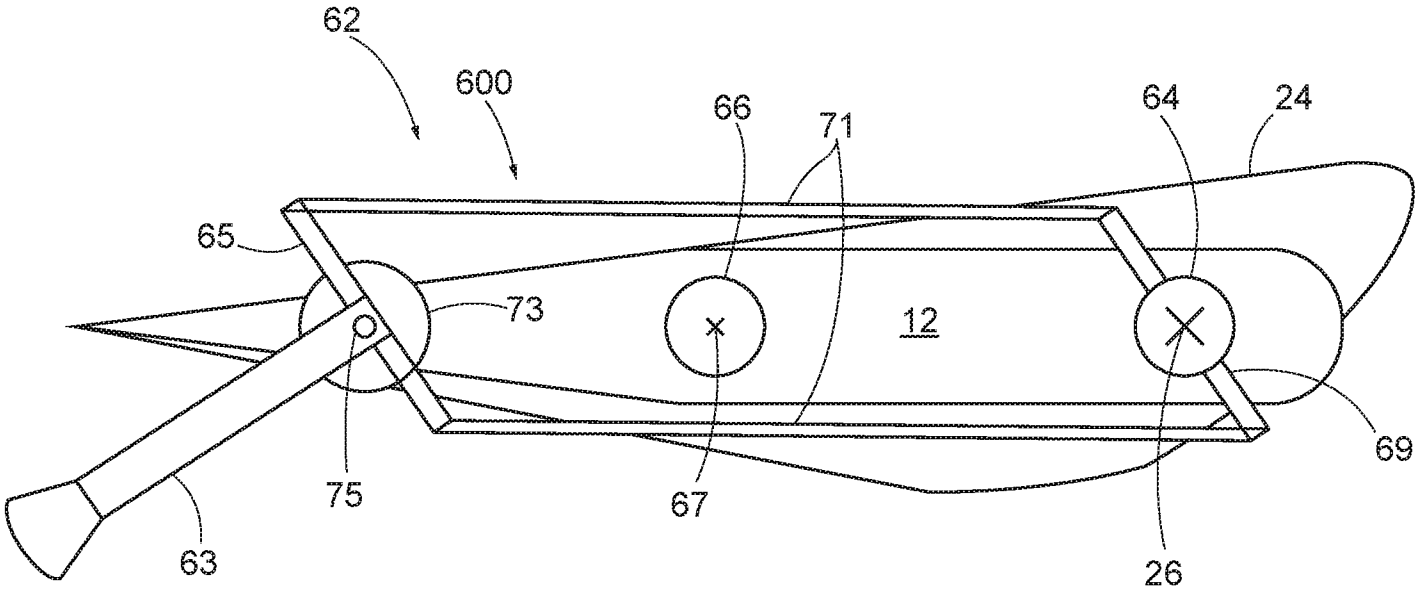
FIG. 6 is a bottom view of the example reversible camber wing of FIG. 2.

When included, as schematically represented in FIG. 1 and shown in the example of FIGS. 3, 5, and 6, the pivot member 64 is aligned with (i.e. centered on) the pivot axis 26, and selectively pivots the second body portion 16 about the pivot axis 26 responsive to selective user input via the user input mechanism 62. In particular, the pivot member 64 comprises an axle or other rotatable shaft that when rotated, causes the second body portion 16 to pivot about the pivot axis 26 due to the coupling of the pivot member 64 to the second body portion 16 at the pivot axis 26. Alternatively, the pivot member 64 may be fixed, and the second body portion 16 may be configured to pivot about the pivot member 64, rather than with the pivot member 64.

As shown in the example of FIGS. 2 and 6, the pivot member 64 extends below the bottom of the second body portion 16. As used herein, "bottom" is used to refer to the bottom of the second body portion 16 when viewed in the orientation shown in FIG. 2. However, it should be appreciated that the reversible camber wings 10 are not limited to the orientation and/or configuration shown in FIG. 2, and that in other examples, the pivot member 64 extends from one or more of a top, side, or other end of the second body portion 16.

In some examples, the pivot member 64 does not extend through the second body portion 16 and is coupled to and/or included at an edge (e.g., bottom) of the second body portion 16. However, in other examples, such as is shown in FIGS. 2, 3, and 5 and mentioned above in the discussion of the at least one hinge member 40, the pivot member 64 extends into the second body portion 16 along the pivot axis 26. In some such examples, (such as is shown in the example of FIG. 2) the pivot member 64 extends through the second body portion 16 and into the first body portion 12. In one such example, (as shown in FIG. 2) the first body portion 12 extends around the top and bottom of the second body portion 16, and the pivot member 64 extends through the bottom of the first body portion 12 and into, but not through, the top of the first body portion 12. In yet further examples, the pivot member 64 does not extend through the second body portion 16 but does include two pieces, one that extends from the top of the second body portion 16 into the first body portion 12, and one that extends from the bottom of the second body portion 16 through the first body portion 12. Thus, the pivot member 64 can extend into the top and bottom of the first body portion 12 without extending all the way through the second body portion 16.

By extending into the first body portion 12, the pivot member 64 provides additional support for the second body portion 16. In particular, the pivot member 64 provides a stronger coupling/connection between the first body portion 12 and the second body portion 16, thereby increasing the durability and longevity of the reversible camber wings 10. Thus, in some such examples, the at least one hinge member 40 is not included because the pivot member 64 may be sufficiently strong by itself to couple the first and second body portions 12 and 16, respectively. Further, by extending through the bottom of the first body portion 12, the pivot member 64 provides a more accessible point at which to couple the user input mechanism 62.

The user input mechanism 62 is configured to selectively receive user input to selectively pivot the second body portion 16 about the pivot axis 26. In particular, in some examples, when the user input mechanism 62 is selectively manipulated by a user, the user input mechanism 62 causes the pivot member 64 to rotate because the user input mechanism 62 is coupled to the pivot member 64. In such examples, rotation of the pivot member 64 in turn causes the second body portion 16 to pivot due to the coupling of the pivot member 64 to the second body portion 16. In other examples, the user input mechanism 62 is coupled to the second body portion 16 and causes the second body portion 16 to pivot about the pivot member 64.

In some examples, the user input mechanism 62 comprises a mechanically actuated mechanism that requires a user to provide a physical, mechanical force. FIG. 6 shows one such example of a mechanically actuated user input mechanism. In particular, FIG. 6 shows a bottom view of the example reversible camber wing 200 of FIG. 2. Example user input mechanism 600 of user input mechanism 62 comprises a handle 63, a first pivotable end 65, a second pivotable end 69, and two connecting sides 71. The handle 63 is coupled and fixed relative to the first pivotable end 65. The first and second pivotable ends 65 and 69, respectively, pivot relative to the two connecting sides 71. In particular, the first pivotable end 65 pivots about a pivotable first end pivot axis 75, and the second pivotable end 69 pivots about the pivot axis 26. Because the handle 63 is coupled and fixed relative to the first pivotable end 65, when a user pivots the handle 63, the first pivotable end 65 pivots about the pivotable first end pivot axis 75 and causes the two connecting sides 71 to translate (to the right in the example of FIG. 6 if the handle 63 is pivoted clockwise), which in turn causes the second pivotable end 69 to pivot about the pivot axis 26. The second pivotable end 69 is coupled to the pivot member 64 and thus causes the second body portion 16 to pivot about the pivot axis 26. In the example of FIG. 6, the second pivotable end 69 extends through the pivot member 64.

Further, in the example of FIG. 6, the first pivotable end 65 is coupled to the first body portion 12 via a mount 73. The first pivotable end 65 is coupled to the mount 73 via a pin or other rotatable axle, and rotates relative to the mount 73. The mount 73 is coupled to the first body portion 12. Thus, the example user input mechanism 600 is coupled to the mount 73 and the pivot member 64. Thus by pushing on the handle 63 of the example user input mechanism 600, a user can selectively pivot the second body portion 16.

Another example of a mechanically actuated user input mechanism comprises the second pivotable end 69, but rather than the lever system shown in FIG. 6 (handle 63, two connecting sides 71, and first pivotable end 65), the user input mechanism 62 comprises cables that are attached to either end of the second pivotable end 69. The cables can be selectively adjusted (e.g., pulled) by a user to pivot the second pivotable end 69 and rotate the pivot member 64, thereby causing the second body portion 16 to pivot about the pivot axis 26.

However, in other examples, and as mentioned above when discussing the at least one bias mechanism 42, the user input mechanism 62 comprises an electronically actuated mechanism. In particular, responsive to user input via one or more of a steering wheel, joystick, keypad, and touchscreen, a controller of the user input mechanism 62 sends electrical signals to one or more electrically controlled actuators (e.g., electromagnetic, pneumatic, hydraulic, etc.) that apply a torsional force to the pivot member 64 that causes the pivot member 64 to rotate and thereby pivot the second body portion 16.

As schematically represent in FIG. 1 and shown in the example of FIGS. 2 and 6-8, the reversible camber wings 10 additionally include a mast 66, in some examples. In some such examples, the mast 66 is coupled to an edge (e.g., bottom) of the first body portion 12. For example, in FIG. 6, the mast 66 is shown coupled to the bottom of the first body portion 12. However, in other examples, the mast 66 extends into the first body portion 12.

The mast 66 is configured to couple the reversible camber wings 10 to another structure, such as a vehicle 68. In some examples, the mast 66 is rotatable relative to the vehicle 68, and in such examples, the mast 66 defines a mast axis 67 about which a reversible camber wing 10 is configured to rotate when included in the vehicle 68. FIGS. 7 and 8 show examples of vehicles 68 in which a mast 66 (and therefore the reversible camber wings 10) is included.

However, in examples where the mast 66 is rotatable about the mast axis 67, the mast axis 67 is not an axis about which the first body portion 12 is independently pivotable relative to the second body portion 16. That is, the first body portion 12 does not pivot about the mast axis 67 relative to the second body portion 16 (i.e. the first body portion 12 is fixed relative to the mast 66). Rather, when the mast 66 rotates, the entire reversible camber wing 200 (including both the first body portion 12 and the second body portion 16) rotates with the mast 66 about the mast axis 67. Thus, for a given mast position, only the second body portion 16 pivots relative to the mast 66 when adjusting between the first camber 28 and the second camber 30. When adjusting between the first camber 28 and second camber 30 therefore, the first body portion 12 does not pivot relative to the mast 66, and only the second body portion 16 pivots relative to the first body portion 12 and mast 66 (i.e. by pivoting between the second-body-portion first position 20 and the second-body-portion second position 22). More simply, the first body portion 12 and second body portion 16 do not both pivot when adjusting between the first camber 28 and second camber 30, only the first body portion 12 does.

In other examples where the mast 66 is not rotatable, the first body portion 12 is similarly fixed relative to the mast 66, such that only the second body portion 16 pivots when adjusting between the first camber 28 and second camber 30.

In particular, FIG. 7 shows an example where the vehicle 68 is a land vehicle 78 and comprises a vehicle body 70 and wheels 72 coupled to the vehicle body 70. FIG. 8 shows an example where the vehicle 68 is a marine vehicle 74 and comprises a hull 76. In the examples of FIGS. 7 and 8, the reversible camber wings 10 are included in the vehicle 68. That is, the vehicle 68 comprises the reversible camber wings 10, in some examples. In such examples, the reversible camber wings 10 are coupled to the vehicle body 70 of the vehicle 68 and extend upward from the vehicle body 70. Upward refers to an upward vertical direction with respect to ground.

In some examples, the reversible camber wings 10 are coupled to the vehicle body 70 via the mast 66. In particular, the mast 66 is operatively coupled to the vehicle body 70, and thus couples the reversible camber wings 10 to the vehicle body 70 since the mast 66, when included, is coupled to the reversible camber wings 10. In some such examples, the mast 66 is fixed relative to the vehicle body 70 and the first body portion 12 pivots about the mast 66. However, in other such examples, the mast 66 is rotatably coupled to the vehicle body 70 and is configured to be selectively rotated relative to the vehicle body 70 via selective user input via a user input device.

Illustrative, non-exclusive examples of reversible camber wings and vehicles according to the present disclosure are presented in the following enumerated paragraphs.

A. A reversible camber wing, comprising:

a first body portion that defines a trailing edge of the reversible camber wing;

a second body portion that defines a leading edge of the reversible camber wing, wherein the second body portion is configured to be selectively pivoted about a pivot axis relative to the first body portion between a second-body-portion first position and a second-body-portion second position; and a flexible skin that extends around the first body portion and the second body portion and that conforms to the first body portion and the second body portion when the second body portion is in the second-body-portion first position and when the second body portion is in the second-body-portion second position;

wherein when the second body portion is in the second-body-portion first position, the reversible camber wing has a first camber, and when the second body portion is in the second-body-portion second position, the reversible camber wing has a second camber that is opposite the first camber.

A1. The reversible camber wing of paragraph A, wherein the first body portion comprises a first-body-portion first surface and a first-body-portion second surface opposite the first-body-portion first surface, wherein with the flexible skin, the first-body-portion first surface defines a portion of a high pressure side of the reversible camber wing when the second body portion is in the second-body-portion first position and thus the reversible camber wing has the first camber, and wherein with the flexible skin, the first-body-portion second surface defines a portion of a high pressure side of the reversible camber wing when the second body portion is in the second-body-portion second position and thus the reversible camber wing has the second camber.

A1.1. The reversible camber wing of paragraph A1, wherein the first-body-portion first surface and the first-body-portion second surface are planar.

A2. The reversible camber wing of any of paragraphs A-A1.1, wherein the first body portion is constructed from one or more of foam, rubber, fiber-reinforced plastic, metal, and wood.

A3. The reversible camber wing of any of paragraphs A-A2, wherein the first body portion comprises a foam core with a fiber-reinforced plastic skin.

A4. The reversible camber wing of any of paragraphs A-A2, wherein the first body portion is hollow.

A5. The reversible camber wing of any of paragraphs A-A4, wherein the second body portion comprises a second-body-portion first surface and a second-body-portion second surface opposite the second-body-portion first surface, wherein with the flexible skin, the second-body-portion first surface defines a portion of a low pressure side of the reversible camber wing when the second body portion is in the second-body-portion first position and thus the reversible camber wing has the first camber, and wherein with the flexible skin, the second-body-portion second surface defines a portion of a low pressure side of the reversible camber wing when the second body portion is in the second-body-portion second position and thus the reversible camber wing has the second camber.

A5.1. The reversible camber wing of paragraph A5, wherein the second-body-portion first surface and the second-body-portion second surface are convex.

A5.2. The reversible camber wing of any of paragraph A-A5, wherein the second body portion comprises a symmetric cross-section and wherein the pivot axis is not centered on the second body portion.

A5.2.1 The reversible camber wing of paragraph A5.2, wherein the pivot axis is more proximate the leading edge than a central axis of the second body portion.

A6. The reversible camber wing of any of paragraphs A-A5.2.1, wherein the second body portion is constructed from one or more of foam, rubber, fiber-reinforced plastic, metal, and wood.

A7. The reversible camber wing of any of paragraphs A-A6, wherein the second body portion comprises a foam core with a fiber-reinforced plastic skin.

A8. The reversible camber wing of any of paragraphs A-A7, wherein the second body portion is hollow.

A9. The reversible camber wing of any of paragraphs A-A8, wherein the flexible skin defines an exterior surface of the reversible camber wing.

A10. The reversible camber wing of any of paragraphs A-A9, wherein the flexible skin is a fabric.

A11. The reversible camber wing of any of paragraphs A-A10, wherein the flexible skin is constructed from one or more of nylon, aramid, polyethylene, and polyester.

A12. The reversible camber wing of any of paragraphs A-A11, wherein the flexible skin is coupled to the first body portion at the trailing edge and/or to the second body portion at the leading edge.

A12.1. The reversible camber wing of paragraph A12, wherein the flexible skin is coupled to the first body portion at the trailing edge and/or to the second body portion at the leading edge via an adhesive and/or fastener.

A13. The reversible camber wing of any of paragraphs A-A12.1, further comprising at least one hinge member extending from the first body portion and defining the pivot axis.

A13.1. The reversible camber wing of paragraph A13, wherein the second body portion comprises at least one channel, and wherein the at least one hinge member extends into a respective one of the at least one channel.

A14. The reversible camber wing of any of paragraphs A-A13.1, further comprising at least one bias mechanism, operatively coupled between the first body portion and the second body portion, wherein the at least one bias mechanism is configured to bias the second body portion toward the second-body-portion first position when the second body portion is selectively pivoted toward the second-body-portion first position and to bias the second body portion toward the second-body-portion second position when the second body portion is selectively pivoted toward the second-body-portion second position.

A14.1. The reversible camber wing of paragraph A14, wherein the at least one bias mechanism is configured to pivot relative to the first body portion between a bias-mechanism first position when the second body portion is in the second-body-portion first position and a bias-mechanism second position when the second body portion is in the second-body-portion second position.

A14.2. The reversible camber wing of any of paragraphs A14-A14.1, wherein the first body portion comprises at least one pocket into which the at least one bias mechanism extends, and wherein the at least one pocket is configured to permit the at least one bias mechanism to pivot relative to the first body portion.

A14.2.1. The reversible camber wing of paragraph A14.2, wherein the at least one pocket is configured to permit the at least one bias mechanism to pivot between the bias-mechanism first position and the bias-mechanism second position.

A14.3. The reversible camber wing of any of paragraphs A14-A14.2, wherein the at least one bias mechanism comprises a strut assembly.

A14.3.1. The reversible camber wing of paragraph A14.3, wherein the strut assembly comprises a piston, a piston-receiving chamber, and a spring that biases the piston away from the piston-receiving chamber when the spring is compressed.

A14.4. The reversible camber wing of any of paragraphs A14-A14.3.1, wherein the at least one bias mechanism comprises a hinge, and wherein the hinge is operatively coupled to the second body portion to permit the at least one bias mechanism to pivot relative to the second body portion.

A14.4.1. The reversible camber wing of paragraph 14.4, wherein the second body portion comprises at least one recess, and wherein the hinge is positioned within the recess.

A14.4.2. The reversible camber wing of any of paragraphs A14.4-A14.4.1 when depending from paragraph A14.3, wherein the strut assembly extends from the hinge opposite the support member.

A14.4.3 The reversible camber wing of any of paragraphs A14-A14.4.2, wherein the at least one bias mechanism further comprises a support member that extends from the hinge and into the second body portion to operatively couple the at least one bias mechanism to the second body portion.

A15. The reversible camber wing of any of paragraphs A-A14.4.3, further comprising a pivot member aligned with the pivot axis and configured to pivot the second body portion about the pivot axis when rotated.

A16. The reversible camber wing of any of paragraphs A-A15, further comprising a user input mechanism configured to selectively receive user input to selectively pivot the second body portion about the pivot axis.

A16.1. The reversible camber wing of paragraph A16, wherein the user input mechanism comprises a handle coupled to the pivot member, wherein the handle is configured to rotate the pivot member when actuated by a user.

A17. The reversible camber wing of any of paragraphs A-A16.1, further comprising a mast coupled to the first body portion, wherein the mast is configured to operatively couple the reversible camber wing to a vehicle.

A17.1. The reversible camber wing of paragraph A17, wherein the mast defines a mast axis about which the reversible camber wing is configured to rotate.

A18. A vehicle, comprising:

a vehicle body; and the reversible camber wing of any of paragraphs A-A17.1, operatively coupled to and extending upward from the vehicle body.

A18.1. The vehicle of paragraph A18, wherein the vehicle is a land vehicle and further comprises wheels operatively coupled to the vehicle body.

A18.2. The vehicle of paragraph A18, wherein the vehicle is a marine vehicle, and wherein the vehicle body comprises a hull.

A18.3. The vehicle of any of paragraphs A18-A18.2 when depending from paragraph A17, wherein the mast operatively couples the reversible camber wing to the vehicle body.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C," and "A, B, and/or C" may mean A alone, B alone, C alone, A and B together, A and C together, B and C together, A, B, and C together, and optionally any of the above in combination with at least one other entity.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

The invention claimed is:

1. A reversible camber wing, comprising:

a first body portion that defines a trailing edge of the reversible camber wing;

a second body portion that defines a leading edge of the reversible camber wing, wherein the second body portion is configured to be selectively pivoted about a pivot axis relative to the first body portion between a second-body-portion first position and a second-body-portion second position, and wherein the second body portion comprises at least one channel;

a flexible skin that extends around the first body portion and the second body portion and that conforms to the first body portion and the second body portion when the second body portion is in the second-body-portion first position and when the second body portion is in the second-body-portion second position; and at least one hinge member extending from the first body portion and defining the pivot axis, wherein the at least one hinge member extends into a respective one of the at least one channel;

wherein when the second body portion is in the second-body-portion first position, the reversible camber wing has a first camber, and when the second body portion is in the second-body-portion second position, the reversible camber wing has a second camber that is opposite the first camber.

2. The reversible camber wing of claim 1, wherein the first body portion comprises a first-body-portion first surface and a first-body-portion second surface opposite the first-body-portion first surface, wherein with the flexible skin, the first-body-portion first surface defines a portion of a high pressure side of the reversible camber wing when the second body portion is in the second-body-portion first position and thus the reversible camber wing has the first camber, and wherein with the flexible skin, the first-body-portion second surface defines a portion of a high pressure side of the reversible camber wing when the second body portion is in the second-body-portion second position and thus the reversible camber wing has the second camber.

3. The reversible camber wing of claim 1, wherein the second body portion comprises a second-body-portion first surface and a second-body-portion second surface opposite the second-body-portion first surface, wherein with the flexible skin, the second-body-portion first surface defines a portion of a low pressure side of the reversible camber wing when the second body portion is in the second-body-portion first position and thus the reversible camber wing has the first camber, and wherein with the flexible skin, the second-body-portion second surface defines a portion of a low pressure side of the reversible camber wing when the second body portion is in the second-body-portion second position and thus the reversible camber wing has the second camber.

4. The reversible camber wing of claim 1, wherein the second body portion is symmetric, and wherein the pivot axis is not centered on the second body portion.

5. The reversible camber wing of claim 4, wherein the pivot axis is more proximate the leading edge than a central axis of the second body portion.

6. The reversible camber wing of claim 1, wherein the flexible skin defines an exterior surface of the reversible camber wing.

7. The reversible camber wing of claim 1, wherein the flexible skin is coupled to the first body portion at the trailing edge and/or to the second body portion at the leading edge.

8. The reversible camber wing of claim 1, further comprising at least one bias mechanism, operatively coupled between the first body portion and the second body portion, wherein the at least one bias mechanism is configured to bias the second body portion toward the second-body-portion first position when the second body portion is selectively pivoted toward the second-body-portion first position and to bias the second body portion toward the second-body-portion second position when the second body portion is selectively pivoted toward the second-body-portion second position.

9. A reversible camber wing, comprising:

a first body portion that defines a trailing edge of the reversible camber wing;

a second body portion that defines a leading edge of the reversible camber wing, wherein the second body portion is configured to be selectively pivoted about a pivot axis relative to the first body portion between a second-body-portion first position and a second-body-portion second position;

a flexible skin that extends around the first body portion and the second body portion and that conforms to the first body portion and the second body portion when the second body portion is in the second-body-portion first position and when the second body portion is in the second-body-portion second position; and at least one bias mechanism, operatively coupled between the first body portion and the second body portion, wherein the at least one bias mechanism is configured to bias the second body portion toward the second-body-portion first position when the second body portion is selectively pivoted toward the second-body-portion first position and to bias the second body portion toward the second-body-portion second position when the second body portion is selectively pivoted toward the second-body-portion second position, wherein the at least one bias mechanism comprises a strut assembly comprising a piston, a piston-receiving chamber, and a spring that biases the piston away from the piston-receiving chamber when the spring is compressed;

wherein when the second body portion is in the second-body-portion first position, the reversible camber wing has a first camber, and when the second body portion is in the second-body-portion second position, the reversible camber wing has a second camber that is opposite the first camber.

10. A reversible camber wing, comprising:

a first body portion that defines a trailing edge of the reversible camber wing;

a second body portion that defines a leading edge of the reversible camber wing, wherein the second body portion is configured to be selectively pivoted about a pivot axis relative to the first body portion between a second-body-portion first position and a second-body-portion second position;

a flexible skin that extends around the first body portion and the second body portion and that conforms to the first body portion and the second body portion when the second body portion is in the second-body-portion first position and when the second body portion is in the second-body-portion second position; and at least one bias mechanism, operatively coupled between the first body portion and the second body portion, wherein the at least one bias mechanism is configured to bias the second body portion toward the second-body-portion first position when the second body portion is selectively pivoted toward the second-body-portion first position and to bias the second body portion toward the second-body-portion second position when the second body portion is selectively pivoted toward the second-body-portion second position, wherein the at least one bias mechanism comprises a hinge, and wherein the hinge is operatively coupled to the second body portion to permit the at least one bias mechanism to pivot relative to the second body portion;

wherein when the second body portion is in the second-body-portion first position, the reversible camber wing has a first camber, and when the second body portion is in the second-body-portion second position, the reversible camber wing has a second camber that is opposite the first camber.

11. The reversible camber wing of claim 10, wherein the second body portion comprises at least one recess, and wherein the hinge is positioned within the recess.

12. The reversible camber wing of claim 10, wherein the at least one bias mechanism further comprises a support member that extends from the hinge and into the second body portion to operatively couple the at least one bias mechanism to the second body portion.

13. A reversible camber wing, comprising:

a first body portion that defines a trailing edge of the reversible camber wing, wherein the first body portion comprises at least one pocket;

a second body portion that defines a leading edge of the reversible camber wing, wherein the second body portion is configured to be selectively pivoted about a pivot axis relative to the first body portion between a second-body-portion first position and a second-body-portion second position; and at least one bias mechanism, operatively coupled between the first body portion and the second body portion, wherein the at least one bias mechanism is configured to bias the second body portion toward the second-body-portion first position when the second body portion is selectively pivoted toward the second-body-portion first position and to bias the second body portion toward the second-body-portion second position when the second body portion is selectively pivoted toward the second-body-portion second position, wherein the at least one bias mechanism extends into the at least one pocket of the first body portion, and wherein the at least one pocket is configured to permit the at least one bias mechanism to pivot relative to the first body portion;

wherein when the second body portion is in the second-body-portion first position, the reversible camber wing has a first camber, and when the second body portion is in the second-body-portion second position, the reversible camber wing has a second camber that is opposite the first camber.

14. The reversible camber wing of claim 1, wherein the first body portion and the second body portion are constructed from one or more of foam, rubber, fiber-reinforced plastic, metal, and wood.

15. The reversible camber wing of claim 1, wherein the flexible skin comprises a fabric constructed from one or more of nylon, aramid, polyethylene, and polyester.

16. The reversible camber wing of claim 1, further comprising a user input mechanism configured to selectively receive user input to selectively pivot the second body portion about the pivot axis.

17. The reversible camber wing of claim 1, further comprising a mast coupled to the first body portion, wherein the mast is configured to operatively couple the reversible camber wing to a vehicle.

18. A vehicle, comprising:

a vehicle body; and the reversible camber wing of claim 1 operatively coupled to and extending upward from the vehicle body.

19. A vehicle, comprising:

a vehicle body; and the reversible camber wing of claim 9 operatively coupled to and extending upward from the vehicle body.

20. A vehicle, comprising:

a vehicle body; and the reversible camber wing of claim 10 operatively coupled to and extending upward from the vehicle body.

21. A vehicle, comprising:

a vehicle body; and the reversible camber wing of claim 13 operatively coupled to and extending upward from the vehicle body.

* * * * *